United States Patent [19]

Bureau

[11] 3,990,769

[45] Nov. 9, 1976

[54] BATTERY TERMINAL

[76] Inventor: Marcel Bureau, 26 Gurnsey Road, Kapuskasing, Ontario, Canada

[22] Filed: Jan. 10, 1975

[21] Appl. No.: 540,065

[30] Foreign Application Priority Data

Oct. 30, 1974 Canada ..... 212,621

[52] U.S. Cl. ..... 339/236

[51] Int. Cl.[2] ..... H01R 11/26

[58] Field of Search ..... 339/236, 240

[56] References Cited

UNITED STATES PATENTS 1,945,437 1/1934 Krueger ..... 339/236

FOREIGN PATENTS OR APPLICATIONS 1,091,782 11/1954 France ..... 339/236

*Primary Examiner*—Roy Lake
*Assistant Examiner*—E. F. Desmond
*Attorney, Agent, or Firm*—Beveridge, DeGrandi, Kline & Lunsford

[57] ABSTRACT

A battery terminal particularly for vehicle batteries is described, and which includes a wedging member operable by screw means including an easily accessible, manually operable knob which can be turned to draw the wedging member firmly into engagement between a surface of the battery post and an inner surface of the terminal body. The terminal body, in addition to the usual socket shaped to receive the battery post, has a recess communicating with the socket, the recess having a base wall facing towards the socket and being so disposed relative to the axis of the socket that the base wall is inclined relative to the adjacent surface of a post inserted into the socket. The wedging member is movable in this recess without rotation, and the screw means urge the wedging member into a position in which it is firmly wedged between the base wall and the adjacent surface of the post.

1 Claim, 3 Drawing Figures

BATTERY TERMINAL

Figure 1:
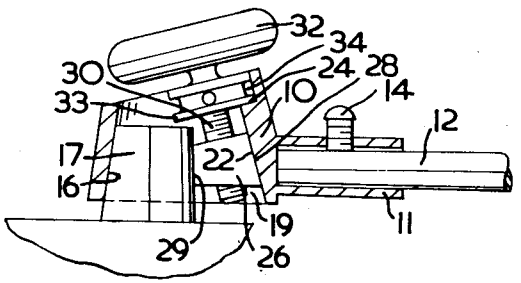

The present invention relates to a battery terminal, particularly for use on vehicle batteries, which terminal is of simple construction and is readily releaseable without tools.

Various battery terminals are known, which include tightening devices for ensuring a positive grip of the terminals on a battery post. However, most such tightening devices need tools for their operation, which is clearly a drawback particularly in emergency situations which can arise, and where it may be dangerous to leave the terminal attached to the battery. As an example, in Canadian Pat. No. 307,259, which issued Jan. 6, 1931 to Berg, a wedging device in a battery terminal, is shown, but this requires the use of a screw driver for release, and this screwdriver has to be applied to a rather awkard position underneath the arm of the terminal. Another drawback of the design shown in this patent is that the wedging member operates only indirectly on the battery post via a sliding part, and tightening of the wedging member involves overcoming sliding friction on two surfaces of the sliding part as well as on two surfaces of the wedging member, and this friction limits the efficiency of the device.

A battery terminal in accordance with the present invention comprises a body having means connectable to an end of a cable, and having a socket for receiving a battery post, the socket having walls forming a partial surface of revolution about an axis, a recess in said body communicating with said socket and having a base wall facing towards said socket and being so disposed relative to the axis of said socket that when a battery post of complementary shape to the socket is inserted therein the said base wall is inclined relative to the adjacent surface of the post. The terminal further comprises a unitary wedging member movable in the recess and having a first wedging surface engageable with the base wall and a second wedging surface engageable with said adjacent surface of the post, and screw means are provided for urging the wedging member into a position into which it is firmly wedged between the base wall and the adjacent surface of the post. The screw means include a hand grip part suitable for manual turning, and accessible for manual use.

The hand grip part is preferably a knob of such diameter that a good turning moment can be applied thereto by hand, the diameter being greater than the maximum diameter of the socket and preferably approximately twice the maximum diameter of the socket or greater.

The socket preferably has walls of upwardly converging frusto conical shape, and the base wall of the recess is preferably disposed relative to the axis of the socket that when a battery post is inserted into the socket, the base wall converges upwardly relative to the adjacent surface of the post, and the screw means are arranged to force the wedging member upwardly into the wedging position. The screw means preferably include a screwed bore in the wedging member and a screw rod in said bore having a hand grip part connected to its upper end, and having a part which engages on an upwardly facing surface on the body so that the rod can apply an upward force to the wedging member.

Figure 3:
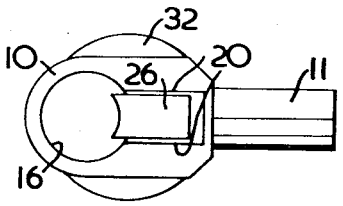
Figure 2:
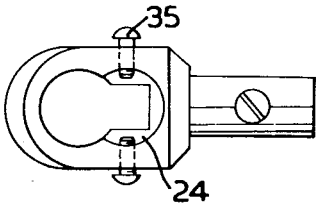

A preferred form of the invention will now be described by way of example with reference to the accompanying drawings, in which:

FIG. 1 shows a sectional elevation through the battery terminal, as installed on a battery post, FIG. 2 shows a top plan view of the terminal itself but with the wedging member and screw means removed, and FIG. 3 shows a bottom view of the terminal itself.

The terminal has a body 10 of cast brass, the body having a hollow arm 11 extending from one side, and suitable for receiving the end 12 of a cable which is held in place by set screw 14. The body also has a socket indicated at 16 for receiving a battery post 17. As shown in FIGS. 2 and 3, the socket 16 is generally circular in cross section, its walls being formed as a surface of revolution about a vertical axis, and more specifically is of upwardly converging frusto conical shape to suit the shape of the battery post. Such posts generally taper upwardly at an included angle which amounts to an angle of taper of 1 ⅓ inch per foot. The inner surface of the socket is interrupted at the side nearest to arm 11, where the socket communicates with a recess 19. The recess has parallel, vertical side walls 20 as shown in FIG. 3, and has a base wall 22 which is flat and converges upwardly relative to the adjacent surface of the post 17. This wall also converges upwardly relative to the vertical axis of the socket. The upper part of recess 19 is bored out to provide an upwardly facing shoulder surface 24 which extends perpendicularly to wall 22.

The recess 19 receives a unitary wedging member 26 having a threaded bore, and having two flat parallel sides so as to be slidable without rotation within the flat sides 20 of the recess, and the wedging member also has a first wedging surface 28 which is parallel to the threaded bore, and a second wedging surface 29 which is parallel or approximately parallel to the adjacent surface of the battery post 17. Screw means are provided for pulling the wedging member upwardly into a position in which this is firmly wedged between the base wall and the adjacent surface of the post, and these screw means include (in addition to the threaded bore in the wedging member) a screwed rod 30 threaded within the bore of the wedging member, and having at its upper end a hand grip knob 32 which is of suitable diameter to be turned by hand, and which in the example shown is about twice the diameter of the battery post. Between the knob and the rod there is provided a collar portion 33 having a flat lower surface, this flat surface being engageable with the upwardly facing surface 24 of the body. The collar 33 also includes an outwardly facing annular channel 34 which receives the end portions of two screws 35 (best shown in FIG. 2) which extend through lateral screwed bores in the body member so that these screw ends retain the collar, and in fact the screw means and the wedging member, in place relative to the terminal, while being sufficiently loose to allow rotation of the knob.

It should be apparent that the battery terminal in accordance with this invention can easily be released, without any tools, by rotating the knob 32 to allow the wedging member 26 to move downwards in the recess, releasing its frictional contact with the battery post. When a post has been replaced in the terminal, the knob 32 can be rotated to draw the wedging member up so that it wedges firmly between the base wall 22 of the recess and the adjacent portion of the battery post. During this movement, downwards movement of the screw rod 30 is prevented by engagement of the collar portion on the shoulder surface 24. The fact that the bore within the wedging member 26 is parallel to the base wall provides for proper sliding movement of the wedging member. Also, the fact that the bore in the upper end of the recess which provides surface 24 subtends an angle of more than 180° at its center (see FIG. 2), along with the presence of the screws 35, ensure that the wedging member does not become accidentally misplaced.

It may be noted that in contrast to Canadian Pat. No. 307,259, there is direct contact between the wedging member and the battery post, with only two surfaces being in friction, and the number of parts used in this terminal is much less than in accordance with this prior patent. Furthermore, the arrangement of the hand knob 32, which is at the top of the terminal and thus in the place most easily accessible to a user, makes for easy use without any tools.

It will be appreciated that various changes may be made in the terminal without departing from the scope of the invention as set out in the attached claims. Thus, instead of brass, an alloy of antimony and lead may be used. The terminal body may be stamped instead of cast. Instead of knob 32, a wing nut may be used.

I claim:

1. A battery terminal for connecting a cable to a battery post, comprising a body having means connectable to an end of the cable and having a socket for receiving said battery post, said socket having walls of upwardly tapering frusto-conical form, a recess in said body communicating with said socket and having a base wall facing towards said socket and being so disposed relative to the axis of the socket that when a battery post of complementary shape to the socket is inserted into the socket the said base wall converges upwardly relative to the adjacent surface of the post, said terminal further comprising a wedging member shaped to move in said recess without rotation and having a first wedging surface engageable with said base wall and a second wedging surface engageable with said adjacent surface of the post, said wedging member having a screwed bore which is parallel to said base wall when said wedging member is in position in the recess, and manually operable screw means including a screwed rod threadedly engaging in said bore and downwardly facing annular surface arranged to engage an upwardly facing surface of said body to limit downward movement of the rod when the rod is rotated, so that the wedging member can be drawn upwardly into wedging engagement between the base wall and the battery post by rotation of said rod, said rod carrying a hand grip part at its upper end, and accessible at the top of the battery terminal, and suitable for manual turning, said screw means includes a part provided with an outwardly facing annular channel, disposed on said rod below said hand grip part, and wherein said body includes at least one screw movable in a bore transverse to said recess and having an end portion locatable in said channel to hold the screw means against removal, while allowing rotation thereof.

* * * * *